US006669560B2

(12) United States Patent
Eklund et al.

(10) Patent No.: US 6,669,560 B2
(45) **Date of Patent: *Dec. 30, 2003**

(54) DEVICE FOR MANUFACTURING PLAYING COUNTERS AND DRAWING SEQUENCES IN A LOTTERY

(75) Inventors: Gert Eklund, Göteborg (SE); Lars Nordberg, Göteborg (SE)

(73) Assignee: IGS Limited (GI)

( * ) Notice: Subject to any disclaimer, the term of this patent is extended or adjusted under 35 U.S.C. 154(b) by 230 days.

This patent is subject to a terminal disclaimer.

(21) Appl. No.: 09/907,381

(22) Filed: Jul. 17, 2001

(65) Prior Publication Data

US 2002/0022511 A1 Feb. 21, 2002

Related U.S. Application Data

(63) Continuation of application No. 09/135,117, filed on Aug. 17, 1998, now abandoned, which is a continuation-in-part of application No. 09/091,195, filed on Nov. 4, 1998, now Pat. No. 6,176,487.

(51) Int. Cl.[7] ..... A63F 3/06

(52) U.S. Cl. ..... 463/17; 463/16; 463/18; 463/19

(58) Field of Search ..... 463/16–22; 273/143 R

(56) References Cited

U.S. PATENT DOCUMENTS

| | | | |
|---|---|---|---|
| 3,826,499 | A | 7/1974 | Lenkoff |
| 5,092,598 | A | 3/1992 | Kamille |
| 5,411,260 | A | 5/1995 | Smith |
| 5,601,287 | A | 2/1997 | Lundin |
| 5,624,119 | A | 4/1997 | Leake |
| 5,772,510 | A | 6/1998 | Roberts |
| 5,791,990 | A | 8/1998 | Schroeder et al. |
| 5,810,664 | A | 9/1998 | Clapper, Jr. |
| 5,813,911 | A | 9/1998 | Margolin |
| 5,931,467 | A | 8/1999 | Kamille |
| 5,938,200 | A | 8/1999 | Markowicz et al. |

FOREIGN PATENT DOCUMENTS

| | | |
|---|---|---|
| WO | WO 94/03873 | 2/1994 |

*Primary Examiner*—Jessica Harrison
*Assistant Examiner*—Carmen D. White
(74) *Attorney, Agent, or Firm*—Oppedahl & Larson LLP

(57) ABSTRACT

Device for manufacturing game pieces and generating movement sequences to be used in a game of chance with a predetermined number of winners. The device includes a printing machine, a computer processor, readable and writeable memory means incorporating a plurality of registers, and a plurality of communication-links. The printing machine prints a start column, an end column, a number of parts, each part comprising a director area, and director patterns on each game piece. The computer processor is configured to obtain game piece manufacturing data incorporating numbers representing maximum vertical differences between the start and end positions of each part. Also, the processor generates one list of director areas for each part, the director areas comprising a director pattern, and sorts the lists so that director patterns resulting in small vertical differences between the start and end positions of each part are arranged to be placed first.

25 Claims, 3 Drawing Sheets

DEVICE FOR MANUFACTURING PLAYING COUNTERS AND DRAWING SEQUENCES IN A LOTTERY

This application is a continuation of U.S. application Ser. No. 09/135,117, filed Aug. 17, 1998, now abandoned which is a continuation-in-part of U.S. application Ser. No. 09/091,195, filed Nov. 4, 1998 now U.S. Pat. No. 6,176,487.

BACKGROUND OF THE INVENTION

The present invention relates to a device for manufacturing game pieces and generating movement sequences to be used in an interactive game of chance with a predetermined number of winners. When the game is played, one of the generated movement sequences is randomly selected. The selected movement sequence comprises a series of directions, directing moves of a player's marker on the game piece; the moves taking place from a start position to an end position on each game piece.

It is essential to be able to guarantee that the prizes in a game of chance, such as a lottery, at least distributed over several plays, yield a certain predetermined number of winners. This means that the number of winning game pieces, and the prizes won are predetermined to occur within a certain range. The prizes on the game pieces could for instance correspond to a certain sum of money or could give the winner a chance to take part in other forms of games having other prizes, such as larger sums of money. However, the process of generating game pieces and movement sequences becomes complicated when the number of game pieces, movement sequences and possible moves from the start to the end positions and possible prize indicator positions on the game pieces is considerable. This is because of the very large number of possible combinations of these parameters.

SUMMARY OF THE INVENTION

A device is provided for generating game pieces and movement sequences used in a game of chance. The game pieces and movement sequences are generated in such a way that a predetermined number of winners is achieved. The game pieces comprise a grid of columns and rows forming grid sections through which a player's marker moves, from a start position to an end position on the game piece. The movement sequences comprise a series of movement instructions to direct movement of the player's marker from the start position to the end position. With respect to just the start and end positions, a vertical difference, in number of grid sections, between the start position and the end position on the game piece is selected, and movement sequences are generated which, when applied to game pieces, result in the player's marker moving from the start position to the end position. Having the end position the selected number of grid sections vertically above or below the start position is a key factor in achieving the predetermined number of winners.

DETAILED DESCRIPTION OF THE INVENTION

The first object of the present invention is to provide a device for generating game pieces and movement sequences in such a way that a predetermined number of winners is achieved.

The second object of the present invention is to provide a device for generating game pieces and movement sequences in such a way that the number of possible combinations of various parameters that affect the generating process, such as the number of movement sequences, different configurations of the game pieces and the positions of the prize indicators on the game pieces becomes manageable; allowing rapid and easy generation of game pieces and movement sequences.

The device for generating game pieces and movement sequences is also aimed at meeting the conventional requirements established for lotteries.

Figure 1:
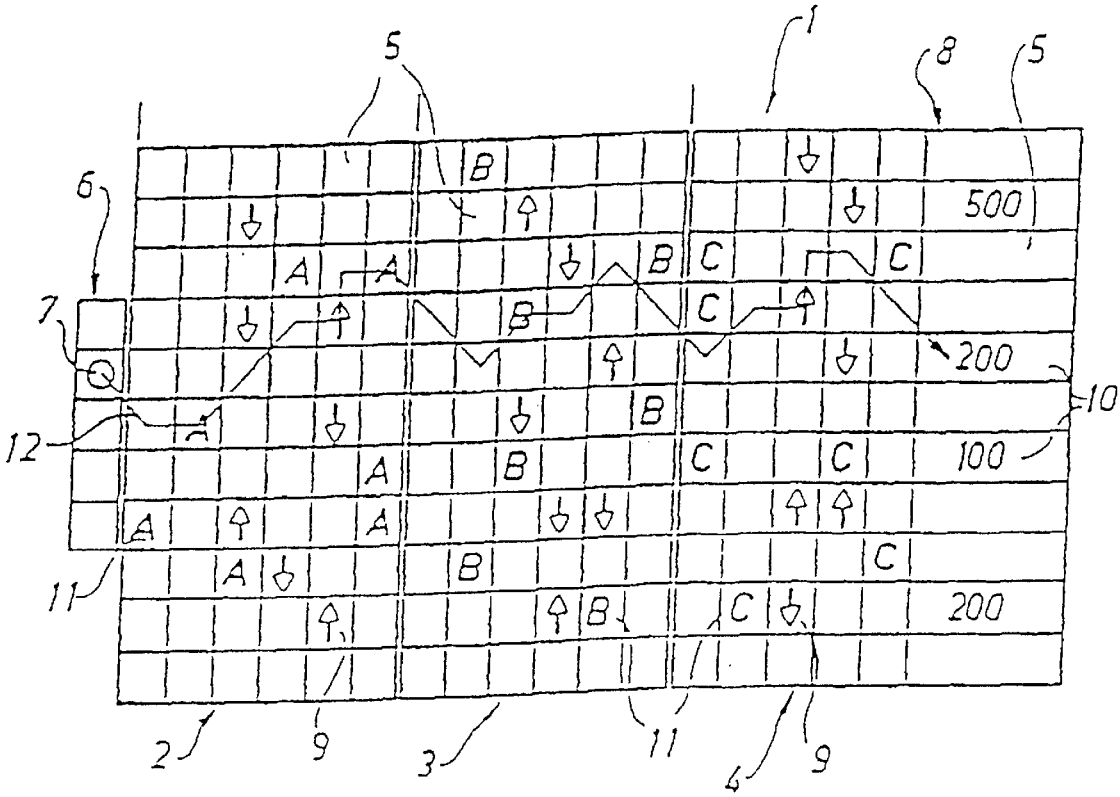
FIG. 1 illustrates one example of a game piece, showing marker moves with respect to one movement sequence from a start position to an end position.

The game piece of FIG. 1, generally referred to by reference 1, is divided into three parts, generally indicated by references 2, 3 and 4, respectively. In accordance with the embodiment shown, each part of the game piece comprises a grid comprising six columns and eleven rows, and the parts 2, 3, 4 are positioned side by side. The columns and the rows delimit grid sections 5, of square configuration in accordance with the embodiment shown. The game piece 1 has a start column generally designated by reference 6. In accordance with the embodiment shown, the start column 6 comprises five sections and is vertically centered about the middle rows of the parts 2, 3 and 4. In one of the sections of the start column 6 is a mark 7 indicating a start position. The game piece 1 also comprises an end column generally designated by reference 8. The end column is a column in part 4 in accordance with the embodiment shown.

The game piece also comprises directors 9. In one embodiment the directors are in the form of arrows pointing vertically upwards or downwards. The directors 9 are disposed in three columns in parts 2 and 3 in accordance with the embodiment shown, and in two columns in part 4. In other embodiments, the directors 9 are present in more or fewer columns, and in different rows on the game piece.

The end column 8 shows a number of prize indicators 10 which in the example illustrated are different sums of money. In some sections of parts 2, 3, 4 there are also prize indicator signs 11, represented by the letters A, B and C. In accordance with the embodiment shown all A's are found in the first part all B's in the second part and all C's in the third part. This is not necessary. Each type of prize indicator sign may appear in one or more parts of the game piece. For example, A's could appear in all parts of the game piece. The number of different types of prize indicator signs 11 could exceed or be lower than that shown.

During the generation process, game pieces of the kind shown in FIG. 1 and movement sequences are created. The movement sequences consist of a series of marker moves which would move a marker from a start position to an end position on the game piece. Once the generation process is completed, the game pieces are sold to players before the movement sequence is presented. During the presentation, one of the generated movement sequences is selected at random and presented to the players. The movement sequence and the directors 9 work in combination to define the movement of a marker across a given game piece. In accordance with the example shown in the figures, the marker moves proceed laterally from the left to the right across grid sections on the game piece. The lateral moves in the movement sequences may be horizontal, diagonally upwards, or diagonally downwards. In FIG. 1, the line indicated by reference 12 indicates one example of marker moves generated by one movement sequence/director combination. When the marker hits a director 9 it should be moved upwards or downwards in the direction indicated, to an adjacent section. Thus, although the same set of moves is designated by the movement sequence, the result (the prize won) will depend on the locations of the directors 9 and the start position. In one embodiment, the start column 6 has an opaque scrape-off cover hiding the start position 7. This feature in combination with the directors 9 and the fact that the movement sequence is preferably disclosed move by move, for example during a television transmission, make the marker moves an exciting part of the game to the player. In the example shown, the player is lucky since the marker hits two prize indicator signs A, which in this example generates a prize, and since the marker hits prize indicator 200, a prize of 200 SEK is awarded.

It is easily understood that the number of possible combinations of parameters, including different movement sequences, different positions of the directors 9, different start positions and different positions of the prize indicators 10 and 11 is large. The number of possible combinations must be limited in the generation of game pieces and movement sequences in order to achieve a predetermined number of winners.

In one embodiment, illustrated in the figures, 10,000 game pieces are to be generated and the movement sequence is selected from 1,000 generated movement sequences.

Each part of the game piece in accordance with the example shown in the figures comprises 729 ($3^6$) possible different series of marker moves which may comprise moves from the left to the right on the game piece in the direction diagonally upwards, diagonally downwards, or horizontally. The various series of marker moves for each part of the game piece together form different movement sequences with respect to that game piece. In accordance with a preferred embodiment certain non-desired series of marker moves and/or movement sequences are sorted out. For example, movement sequences and/or series of marker moves comprising more than three identical moves in sequence may be sorted out, since such movement sequences and/or series of marker moves may be felt as less exciting by the player. For the same reasons, in accordance with the preferred embodiment, movement sequences, which, in total, comprise more than seven identical marker moves are sorted out.

Figure 2:
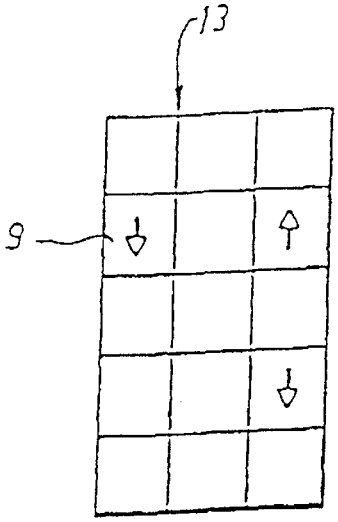
FIG. 2 illustrates one example of a director area of a game piece.

Each part 2, 3, 4 of the game piece, in accordance with the shown embodiment, comprises a director area, generally indicated in FIG. 2 by reference 13. In the embodiment illustrated, the director area 13 has a width of three columns and a height of five rows, but the size may be varied. Preferably, the director area has a size and location such that it covers sections in only one part of the game piece in order to facilitate the generation process. For the director area 13 of each part of the game piece, a list of director patterns 14 is generated. The director patterns 14 show different possible ways of positioning the directors 9 in the director area 13 of the sections 5. One list for each part of the game piece is stored in a second register in the computer processor. FIG. 2 illustrates one example of director positions in an director pattern 14 relating to director area 13. The number of directors in each director pattern 14 preferably is restricted to ensure that the directors 9 will not be too close to one another. In a preferred embodiment, the number of directors 9 in each director pattern is limited to one, two, or three.

Figure 4:
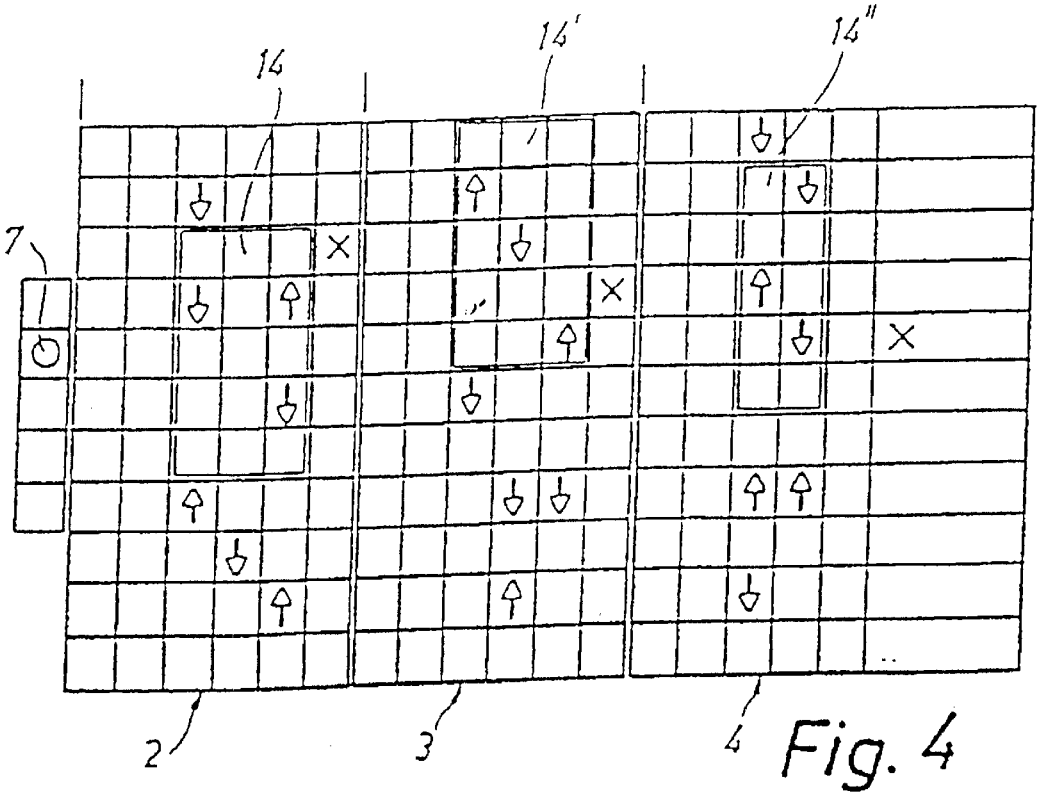
FIG. 4 illustrates one example of the disposition of director areas on the game piece of FIG. 1.

FIG. 4 illustrates one example of a game piece in which three director patterns 14, 14', 14" are set out. Each one of these patterns has three directors. Director pattern 14" comprises only two columns. A very large number of different combination possibilities exists between different patterns. In order to make the generation process manageable, the number of pattern combinations should be restricted.

The list of director patterns 14 for the first part is sorted in such a manner that the patterns 14 producing numbers of small step $S_1$, comprising the largest number of series of marker moves appear first. The list of director patterns 14' relating to the second game piece part 3 is sorted in such a manner that the patterns 14' generating small step $S_2$ comprising the largest number of series of marker moves appear first and the list of director patterns 14" relating to the third part 14 is sorted in such a manner that the pattern 14" generating small step $S_3$ comprising the largest number of series of marker moves appears first. The result is stored in a third register for each part.

A number of patterns are then randomly selected from each one of the three sorted lists, the selected patterns being stored in a fourth register in the computer processor. It should be noted that the lists in the third register are sorted in such a manner that the patterns that may be combined with the largest number of series of marker moves appear first. These are the best series of marker moves. The selection is preferably performed using a random-number distribution which is not linear in the population but configured in such a manner that the first, best series of marker moves has the best chance of being selected.

Thereafter a list is generated of the series of marker moves which, when applied to the patterns in the fourth register relating to the first part 2 of the game piece, continues to produce the above-mentioned small step $S_1$. The generated list is stored in a fifth register relating to part 2 of the game piece. In the same manner, lists of the series of marker moves relating to the second and third parts of the game piece are generated, which when applied to the associated pattern in the fourth register produces the abovementioned small steps $S_2$ and $S_3$, respectively. Since the number of series of marker moves is thus restricted, it is advantageous to be able to combine patterns with many associated series of marker moves to obtain a list containing a sufficient number of selection lists to produce the correct number of small steps in all patterns of the part of the game piece. This is the reason behind the non linear random-number distribution mentioned above.

In this manner a list of patterns and series of marker moves is produced for each part of the game pieces which together produce marker moves corresponding to the small steps of the part of the game piece.

Three patterns from the fourth registers of the different game piece parts are now combined and positioned on a game piece. In accordance with the example in FIG. 4, the pattern of the first part is centered around a preferably randomly selected row comprising start position 7. In the first part, the number of small step $S_1$ is −2. Since all of the series of marker moves in the first part all start in the same start position 7 and are all restricted to produce marker moves extending through the pattern 14 and since all of the series of marker moves of the first part have the same small steps $S_1$, all these series of marker moves have a common end point for the first part of this game piece, which is indicated by an X in the right-hand column in FIG. 4. The pattern 14' of the second part is also given a common starting point (position of the X) on this game piece, about which the pattern 14' is centered. Since the series of marker moves of the second part all start in the same point (the X) and since all of the series of marker moves for the second part are restricted to produce marker moves extending through the pattern 14', and since all of the series of marker moves for the second part have the same step $S_2$, all of these series of marker moves also have a common end point on this game piece, which is marked by an X in the right-hand column of the second game piece part. The pattern 14" of the third part of the game piece is centered in a similar manner and since corresponding restrictions apply in the third game piece part, the end position predetermined in relation to the starting position is always generated, which position in this case is marked by an S in the end column in the fifth row from the top, i.e. in the same row as the start position, since in this case S=0.

It is to be understood that the appearance of the game piece changes when different patterns are combined and when different start positions are selected. If the total number of game pieces having different pattern positions still is less than the desired number, which in this case is 10,000, some of the combinations are re-used to give the desired number of game pieces. Game pieces having identical patterns and start positions are likely to be given different appearances, owing to the positioning of prize indicator signs 10 and 11 and directors 9 which are positioned externally of the patterns as will be described in the following.

The three lists, one for each part of the game piece, comprising series of marker moves having a length of six steps in the respective fifth registers are then combined in order to produce a set of movement sequences having a length of 18 steps which are stored in a sixth register. 18 steps are needed to move a marker from the start position to the end position because each of the three parts has 6 columns. When a player's marker hits a director, the marker moves in the direction indicated by the director, and this additional move is not considered an additional step. Owing to the generating method all these movement sequences produce the same S for each game piece produced. In accordance with a preferred embodiment, an extra run-through of the movement sequences is made, maximizing the number of allowable steps of the same kind to seven and ensuring that no more than three identical marker moves in succession exist. If the number of generated movement sequences is less than the desired number, in this case 1,000, the generating process must be re-started from the beginning.

In accordance with a preferred embodiment, is ensured that the marker will not be positioned outside the game piece. This may be achieved by applying all of the generated movement sequences to each game piece and sorting out movement sequences producing the above problems.

As described above, the movement sequences produce a predetermined number of winners with respect to the prize indicators in the end column. In a preferred embodiment, prize indicator signs are also placed in sections that are not hit by the marker in both prize-winning and blank game pieces in order to increase the player's excitement. Examples of such an arrangement is shown in FIG. 1 in which the sum SEK 500 is not scored.

The embodiment in FIG. 1 also comprises prize indicator signs 11. When a prize indicator sign is hit by the marker, the player wins the corresponding prize. In another embodiment, more than one indicator must be hit by the marker in order to win the prize. Preferably these prizes also have a predetermined number of winners. This, however, raises a problem since at the time the game piece is printed the movement sequence to be selected is still unknown. This problem is solved by the present invention by applying all movement sequences in the sixth register to each game piece. For each movement sequence, data relating to which sections are hit by the marker on each game piece is then stored in a seventh register. The system counts the number of marker hits in each section. This data is also stored in the seventh register.

Figure 3:
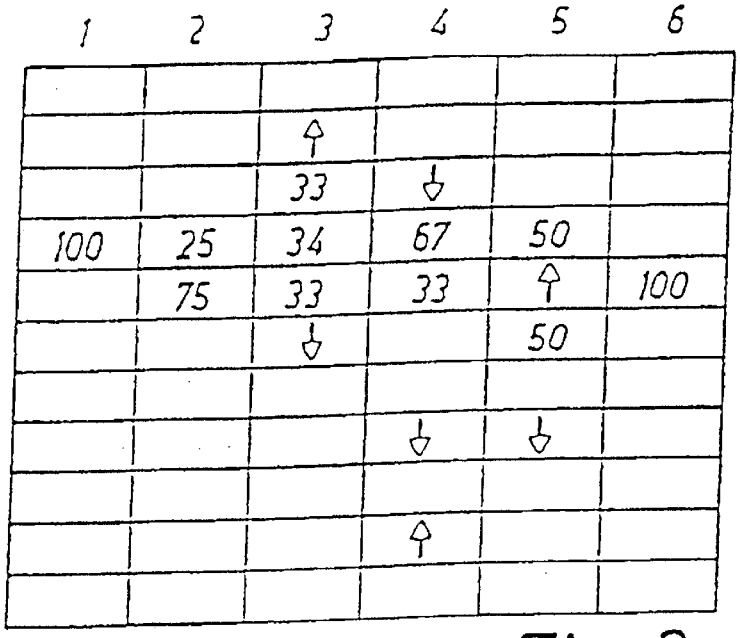
FIG. 3 illustrates on an enlarged scale a part of the game piece of FIG. 1, showing digits indicating the distribution by percentage of the number of marker hits in the movement series with respect to different sections of the game piece.

In this manner the system tracks which sections are hit on each game piece and the number of hits in each section of all game pieces. FIG. 3 illustrates schematically a distribution of hits by percentage of all movement sequences with respect to a part, such as the first part, of all game pieces.

In the most simple case it suffices that the marker hits a prize indicator in order for the player to win a prize. Initially, a column in which the prize producing indicator is to be positioned is selected, preferably at random. For example, column 4 in FIG. 3 is selected. In this column there are two sections with multiple hits. For the sake of simplicity we assume that only one marker-related prize is to be set out. A first game piece is selected, preferably at random, for example one having at least one or several marker hits in the upper one of the two hit sections of column 4, and a second game piece is selected preferably at random, which has at least one or several marker hits in the lower one of the two hit sections of column 4. A prize indicator is placed on the first game piece in the upper one of the two hit sections of column 4 and a prize sign indicator is placed on the second game piece in the lower one of the two hit sections of column 4. Thus a prize is ensured in column 4, independently of the movement sequence that is selected in the lottery.

In another embodiment, a prize is obtained if two prize indicator signs are hit by the marker. In the same manner as above, two columns in which prize-producing signs are to be found are selected. For example, columns 2 and 5 in FIG. 3 are chosen. In each one of these columns two sections are hit. This gives rise to four possible movement sequence combinations. Four game pieces are randomly selected, and prize indicator signs are positioned on these game pieces in the hit sections such that a first game piece has prize indicator signs in the two upper hit sections of columns 2 and 5, a second game piece has prize indicator signs in both the two lower hit sections in columns 2 and 5, a third game piece has prize indicator signs in the upper hit section of column 2 and the lower hit section in column 5, and a fourth game piece has signs in the lower hit section of column 2 and the upper hit section in column 5.

In another embodiment, "blind" prize signs not yielding prizes are placed in some sections that are not hit in any movement sequence, or in such a manner that not all signs required for a prize are hit, in order to enhance the player's excitement. In one embodiment, two or more of a single type of prize indicator signs must be hit in order to win a prize. As shown in the example in FIG. 1, the player wins prize "A" because two of the A's were hit. According to a preferred embodiment, the sections that contain directors 9 in the patterns of each game piece are listed and stored. No prize indicator signs are arranged in such "occupied" sections. "Blind" directors in some sections which are not hit in any movement sequence may also be listed and stored. Such directors are shown in FIG. 4 lying outside of the director patterns. These "blind" directors are arranged in sections of the patterns not hit in any movement sequence. When positioning these "blind" indicators it is preferable to list and store data relating to which sections have become "occupied", in order to ensure that directors and prize indicator signs are not positioned on top of one another. Preferably, the "blind" signs and the directors are arranged at random on the non-"occupied" sections.

Figure 5:
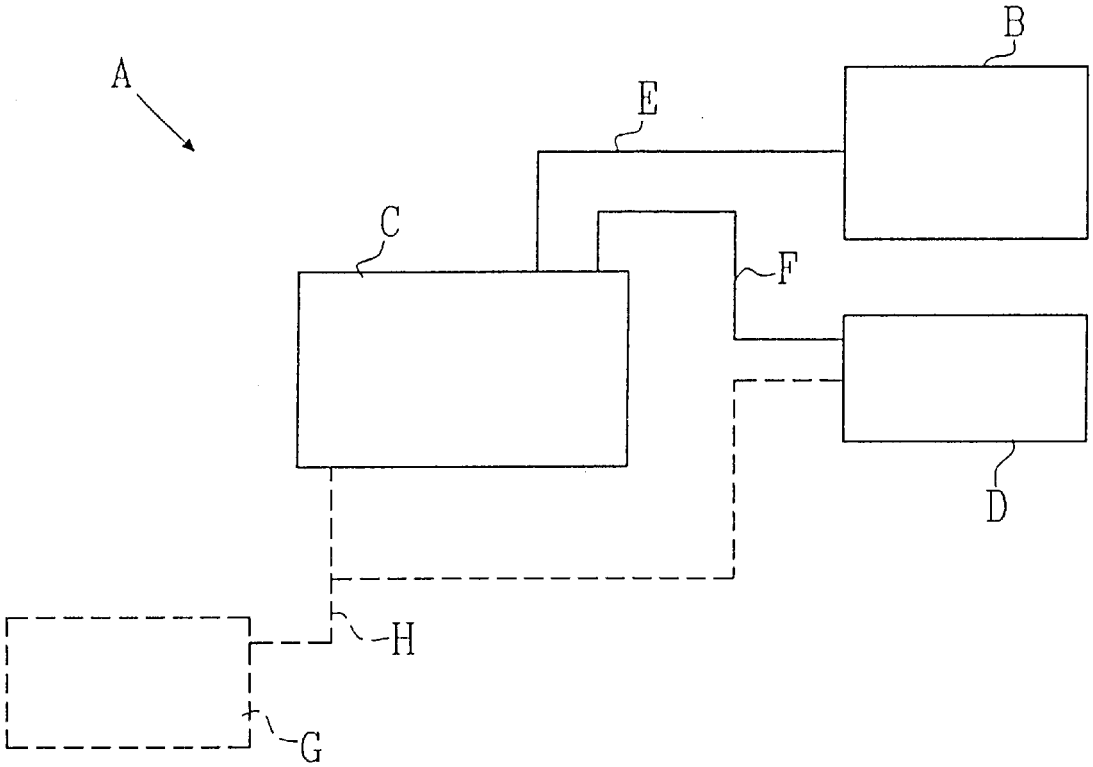
FIG. 5 illustrates the device for manufacturing game pieces according to the present invention.

A device for manufacturing the game pieces and generating the movement sequences is shown in FIG. 5. The device A comprises at least a printing machine B, a computer processor C, readable and writeable memory means D which incorporates a plurality of registers, and a plurality of communication links E, F and H. The printing machine, the computer processor, the communication links and the memory means can be any known components which perform the required tasks. The memory means can be a hard disk or random access memory (RAM). Most known memory means can be or used in the present invention. The communication links may be the internal buses of a general purpose computer.

The computer processor C is connected to the printing machine B by means of a first communication link E, and to and the memory means D by means of a second communication link F. The printing machine B is configured to print a start column (reference number 6 in FIG. 1) and an end column 8, and a number of parts 2, 3, 4, on the game piece. Each part of the game piece comprises a director area 13 (FIG. 2), and director patterns 14, 14', 14" (FIG. 4) on each game piece 1.

The computer processor C is configured to obtain game piece manufacturing data from a first register by means of the second communication link F. The manufacturing data incorporates numbers representing maximum vertical differences, in number of grid sections, between the start and end positions for each part 2, 3 and 4.

The computer processor C is also configured to generate one list of director areas 13 for each part 2, 3 and 4. The director areas 13 comprise a director pattern 14, 14', 14" and are smaller than the associated parts 2, 3, 4. The lists are stored in a second register by means of the second communication link F.

The computer processor C is also configured to sort the lists in the second register so that director patterns 14, 14', 14" resulting in small vertical differences between the start and end positions of each part 2, 3, 4 are placed first. The sorted lists are stored in a third register by means of the second communication link F.

The computer processor C is also configured to select a number of director patterns 14, 14', 14" for each part 2, 3, 4 using a random number generator. The director patterns 14, 14', 14" are obtained from the third register by means of the second communication link F. The random number generator is configured to give preference to the beginning of the lists, which are stored in a fourth register by means of the second communication link F.

The computer processor C is also configured to generate one list of selected movement series comprising moves for a marker for each part 2, 3, 4. The lists, when applied to the director patterns 14, 14', 14" in the fourth register, result in vertical differences between the start and end positions of each part 2, 3, 4. The lists are stored in a fifth register by means of the second communication link F.

The computer processor C is also configured to select for all game pieces to be manufactured, one director pattern 14, 14', 14" for each part 2, 3, 4 from the fourth register by means of the second communication link F.

The computer processor C is also configured to transmit, by means of the first communication link E, data concerning the start column 6, the end column 8, the number of parts (2, 3, 4), director patterns 14, 14', 14", and their positions in each part 2, 3, 4 to the printing machine B for printing the parts 2, 3, 4 on a game piece.

It should be noted that the functions of the hardware components described above and the way in which the hardware components are connected may be achieved by any hardware capable of performing the required tasks.

In a specific embodiment, the sum of the numbers representing vertical differences between the start and end positions is constant for every game piece. Also in a specific embodiment, the number of parts 2, 3, 4 is three and the parts 2, 3, 4, each comprise 11 rows and 6 columns. One or more marks 7 is arranged in the start column 6 in order to indicate a start position. The directors 9 are arrows positioned to point in one of the directions of upwards, downwards, right, diagonally upwards and right, and diagonally downwards and right. The parts 2, 3, 4 are arranged side by side and the start and end columns 6, 8 are arranged to the left and to the right of the parts, respectively.

Game piece manufacturing data is input into the computer processor C by data input means G, such as a keyboard, the data input means G being connected to the computer processor C or to the machine-readable memory means D via a communication link H. The printing machine B is configured to print prize indicator signs 11 on the game pieces. The printing machine B is also configured to place an opaque scrape-off cover hiding the start position on the start column 6 on the game pieces. Prize indicator signs 11 are positioned on parts 2, 3, 4, in order to indicate a prize winning situation when a predetermined number of indicator signs 11 have been hit by the marker. The number of directors 9 in each director pattern 14, 14', 14" is limited to one, two, or three.

In order to obtain a predetermined number of winners with respect to the prize indicators 10 in the end column and to make a manageable generation process possible, an initial difference of a total number of grid sections S vertically between the start and end positions is selected. In accordance with the shown example S=0. In accordance with a preferred embodiment, S is the same for all game pieces, a feature which facilitates the generation process. Once S is determined, it is easy to select, preferably at random, a number of game pieces presenting a prize in the end column. These game pieces should be formed with a start position the location of which, i.e. the vertical position in the column, generates a predetermined end position in the end column, independent of the selected movement sequence. A prize indicator 10 is then printed in the end position. All other game pieces that should not have a prize in the end column have no prize indicator in the end position. Alternatively, the system may be based on a predetermined prize indicator location in the end column, for instance in the form of pre-printed prizes in certain sections of the end column. In this case, the location of the start position is selected in such a manner that certain, preferably random-selected prize game pieces are generated. Once S is established, the game pieces are divided into parts, such as 2, 3, 4, in order to further facilitate the generation process. For each part it is determined, preferably at random, the desired difference in heights $S_i$, known as small steps, between the grid sections in the first and the last columns in the direction of marker moves with respect to each part 2, 3, 4. The sum of the small steps should be S, i.e. $S_1+S_2+\ldots+S_i=S$. In accordance with the shown example the small step $S_i=-2$ in the first part. In the second part the small step $S_2=+1$ and in the third part the small step $S_3=+1$ (i.e. $S=S_1+S_2+S_3=-2+1+1=0$). In accordance with a preferred embodiment, $S_i$ is common to the first part of all game pieces (e.g. −2) and $S_i$ is common to the second parts of all game pieces (e.g. +1) and $S_i$ is common to the third parts of all game pieces (e.g. +1); all game pieces thus having the same small step in mutually corresponding parts, which facilitates the generation process. In accordance with the preferred embodiment, the small steps are chosen within the range −2 to +2 and S is chosen within the range −6 to +6. The chosen small steps are stored in the first register.

The system, method and device of the invention ensure a predetermined number of winners. Owing to the division of the game piece into parts comprising definite numbers of small steps and owing to the division of the parts in accordance with a preferred embodiment into director areas in which directors may be positioned and by means of which the marker is moved by the series of marker moves, the number of possible combinations in the generation process becomes manageable. This results in the rapid generation, using a device comprising a computer, of game pieces and movement sequences, while at the same time retaining the requirement for a random quality in the selection of winning game pieces.

It shall be understood that certain changes of the inventive method and device are possible. For instance, the appearance of the game piece, the size of its parts and the patterns etc. illustrated in the figures are to be regarded as non-restricting embodiments. It is also possible to have a larger or smaller number of parts to the game piece. It is not necessary to generate directors on the game piece. However, the generation of directors is preferable, since such directors increase the player's excitement and makes the game more interactive. The description of the method and device of this invention is not intended to be limiting to this invention, but is merely illustrative of the preferred embodiment.

What is claimed is:

1. A device for manufacturing game pieces and generating movement sequences to be used in a game of chance with a predetermined number of winners, the device comprising a printing machine, a computer processor, readable and writeable memory means incorporating a plurality of registers, and a plurality of communication links; wherein the printing machine prints on each game piece a start column containing a start position, an end column containing an end position, and a number of parts made up of a grid of columns and rows forming grid sections; wherein each part comprises a director area, the director area containing director patterns; the director patterns comprising at least one director; wherein the computer processor is connected to the printing machine by means of a first communication link and to the memory means by means of a second communication link; wherein the computer processor (a) obtains game piece manufacturing data from a first register by means of the second communication link, the manufacturing data incorporating numbers representing maximum vertical differences, in number of grid sections, between the start and end positions of each part;

(b) generates one list of director areas for each part, the director areas comprising a director pattern, the director areas being smaller than their corresponding parts; wherein the list or lists of director areas are stored in a second register by means of the second communication link;

(c) sorts the lists in the second register so that director patterns resulting in small vertical differences between the start and end positions of each part are placed first, the sorted lists being stored in a third register by means of the second communication link;

(d) selects, by means of the second communication link, a number of director patterns from the third register using a random number generator, the random number generator being configured to give preference to the director patterns at the beginning of the lists, the director patterns being stored in a fourth register by means of the second communication link;

(e) generates a list of movement sequences for each part, wherein the lists, when applied to the director patterns in the fourth register, result in specific vertical differences between the start and end positions of each part; wherein the lists are stored in a fifth register by means of the second communication link;

(f) selects, by means of the second communication link, for all game pieces to be manufactured, one director pattern for each part from the fourth register, combines the director patterns and determines their positions on parts on a game piece; and (g) transmits, by means of the first communication link, data concerning start and end columns, the number of parts, director patterns and their positions in each part to the printing machine for printing the parts on a game piece, wherein a mark is printed in the start column to indicate a start position.

2. The device according to claim 1, wherein the sum of the numbers representing vertical differences between the start and end positions is constant for every game piece.

3. The device according to claim 1, wherein the number of parts in each game piece is three and each part comprises 11 rows and 6 columns.

4. The device according to claim 1, wherein the directors are arrows positioned to point upwards, downwards, right, diagonally upwards and right, or diagonally downwards and right.

5. The device of claim 1, wherein the game pieces are divided vertically into parts, wherein a first part of the game piece comprises the start position, a second part of the game piece comprises the end position, and zero, one or more parts are between the first and second parts; wherein the movement sequence results in movement instructions directing a player's marker from the start position to the end position, resulting in a selected vertical difference in the number of grid sections between the start and end positions on the game piece, wherein the predetermined number of winners is achieved.

6. The device according to claim 5, wherein the parts are arranged side by side and the start and end columns are arranged to the left and to the right of the parts, respectively.

7. The device according to claim 5, wherein the computer processor generates sets of partial movement sequences for each part, the partial movement sequences providing vertical differences in each of the parts; wherein the sets of partial movement sequences are combined to achieve a complete drawing sequence which provides a selected total vertical difference.

8. The device according to claim 1, wherein the game piece manufacturing data is input by a data input means, wherein the data input means is connected to the computer processor or to the machine-readable memory means via a communication link.

9. The device according to claim 8, wherein the data input means is a keyboard.

10. The device according to claim 1, wherein the printing machine prints prize indicators on the game pieces.

11. The device according to claim 1, wherein the printing machine places an opaque scrape-off cover on the start column on the game pieces.

12. The device according to claim 1, wherein the printing machine prints prize indicators in one or more of the parts, wherein the prize indicators indicate a prize winning situation when a predetermined number of indicators have been hit by a marker.

13. The device according to claim 1, wherein the number of directors in each director pattern is limited to one, two, or three.

14. A device for manufacturing game pieces and generating movement sequences to be used in a game of chance with a predetermined number of winners, the device comprising a printing machine, a computer processor, readable and writeable memory means incorporating a plurality of registers, and a plurality of communication links; wherein the printing machine prints on each game piece a start column containing a start position, an end column containing an end position, and a number of parts made up of a grid of columns and rows forming grid sections; wherein each part comprises a director area, the director area containing director patterns; the director patterns comprising at least one director; wherein the computer processor is connected to the printing machine by means of a first communication link and to the memory means by means of a second communication link; wherein the computer processor (a) obtains game piece manufacturing data from a first register by means of the second communication link, the manufacturing data incorporating numbers representing maximum vertical differences, in number of grid sections, between the start and end positions of each part;

(b) generates one list of director areas for each part, the director areas comprising a director pattern, the director areas being smaller than their corresponding parts; wherein the lists or lists of director areas are stored in a second register by means of the second communication link;

(c) sorts the lists in the second register so that director patterns resulting in small vertical differences between the start and end positions of each part are placed first, the sorted lists being stored in a third register by means of the second communication link;

(d) selects, by means of the second communication in, a number of director patterns from the third register using a random number generator, the random number generator being configured to give preference to the director patterns at the beginning of the lists, the director patterns being stored in a fourth register by means of the second communication link;

(e) generates a list of movement sequences for each part, wherein the lists, when applied to the director patterns in the fourth register, result in specific vertical differences between the start and end positions of each part; wherein the lists are stored in a fifth register by means of the second communication link;

(f) selects, by means of the second communication link, for all game pieces to be manufactured, one director pattern for each part from the fourth register, combines the director patterns and determines their positions on parts on a game piece; and (g) transmits, by means of the first communication link, data concerning start and end columns, the number of parts, director patterns and their positions in each part to the printing machine for printing the parts on a game piece, wherein the directors are arrows positioned to point upwards, downwards, right, diagonally upwards and right, or diagonally downwards and right.

15. The device according to claim 14, wherein the sum of the numbers representing vertical differences between the start and end positions is constant for every game piece.

16. The device according to claim 14, wherein the number of parts in each game piece is three and each part comprises 11 rows and 6 columns.

17. The device of claim 14, wherein the game pieces are divided vertically into parts, wherein a first part of the game piece comprises the start position, a second part of the game piece comprises the end position, and zero, one or more parts are between the first and second parts; wherein the movement sequence results in movement instructions directing a player's the marker from the start position to the end position, resulting in a selected vertical difference in the number of grid sections between the start and end positions on the game piece, wherein the predetermined number of winners is achieved.

18. The device according to claim 17, wherein the parts are arranged side by side and the start and end columns are arranged to the left and to the right of the parts, respectively.

19. The device according to claim 17, wherein the computer processor generates sets of partial movement sequences for each part, the partial movement sequences providing vertical differences in each of the parts; wherein the sets of partial movement sequences are combined to achieve a complete drawing sequence which provides a selected total vertical difference.

20. The device according to claim 14, wherein the game piece manufacturing data is input by a data input means, wherein the data input means is connected to the computer processor or to the machine-readable memory means via a communication link.

21. The device according to claim 20, wherein the data input means is a keyboard.

22. The device according to claim 14, wherein the printing machine prints prize indicators on the game pieces.

23. The device according to claim 14, wherein the printing machine places an opaque scrape-off cover on the start column on the game pieces.

24. The device according to claim 14, wherein the printing machine prints prize indicators in one or more of the parts, wherein the prize indicators indicate a prize winning situation when a predetermined number of indicators have been hit by a marker.

25. The device according to claim 14, wherein the number of directors in each director pattern is limited to one, two, or three.

* * * * *